United States Patent [19]

Clogg

[11] 3,945,410

[45] Mar. 23, 1976

[54] CATALYTIC CONVERTER CANNISTER EMPTYING AND FILLING DEVICE

[75] Inventor: William G. Clogg, Madison Heights, Mich.

[73] Assignee: Kent-Moore Corporation, Warren, Mich.

[22] Filed: Apr. 1, 1974

[21] Appl. No.: 456,833

[52] U.S. Cl. ..... 141/67; 23/288 F; 141/378; 259/DIG. 42

[51] Int. Cl.[2] ..... B65B 1/08

[58] Field of Search ..... 23/288 F; 141/1, 5, 8, 141/11, 12, 65–68, 71–80, 84, 93, 98, 270, 324, 340, 363, 364, 369, 375, 378; 222/193; 259/72, DIG. 42

[56] References Cited

UNITED STATES PATENTS

| | | | |
|---|---|---|---|
| 3,184,291 | 5/1965 | Calvert | 141/67 X |
| 3,186,804 | 6/1965 | Fisher | 141/67 X |
| 3,295,565 | 1/1967 | Grandy | 141/67 |
| 3,858,628 | 1/1975 | Bendle | 141/74 X |
| 3,865,159 | 2/1975 | Mayfield | 141/67 |

*Primary Examiner*—Houston S. Bell, Jr.
*Assistant Examiner*—Frederick R. Schmidt
*Attorney, Agent, or Firm*—Burton and Parker

[57] ABSTRACT

Catalytic converter emptying and filling device attachable to the housing of a catalytic converter containing means therein defining a bed for storing catalytic pellets and further having a port therein for emptying the pellets from the bed and housing. The device includes a rigid conduit connectable to the port for passing the pellets to a receptacle or cannister rigidly attached to the conduit for receiving the pellets from the converter and further including a vibrating instrumentality rigidly attached to the device for imparting vibrational turbulence not only to the rigid assembly making up the device but also to the converter housing and the pellets therein to cause the pellets to pass rapidly from the converter through the conduit to the receptacle or in the opposite direction.

2 Claims, 2 Drawing Figures

CATALYTIC CONVERTER CANNISTER EMPTYING AND FILLING DEVICE

BACKGROUND OF THE INVENTION

With the increased emphasis in attempting to purify atmospheric air various techniques have been suggested for controlling the pollutants which are emitted from an internal combustion engine. One of the means suggested is the use of a catalytic converter which employs various catalysts to purify the exhaust fumes of the internal combustion engine. The catalyst in the purifier is generally pellet size, normally substantial spherical, having a diameter of about 0.02 to about 0.25 inches. The pellets catalyze the conversion of the impurities in the exhaust to non-toxic gases. Generally the catalysts are precious metal or noble metal catalyst such as platinum, palladium and the like, although base metals may also be employed. The difficulty with such catalytic converters is the need for periodically replacing the catalyst which have served their purpose for a period of time or become contaminated due to the presence of lead in gasoline.

Various techniques have been suggested for maintenance of the catalytic exhaust purifier such as that in U.S. Pat. No. 3,184,291 as well as U.S. Pat. No. 3,295,565. The difficulty with the prior art is that a satisfactory means for practically efficiently and consistently removing the pellets from the catalytic converter has not been found.

Accordingly, it is an object of the present invention to provide a catalytic converter emptying device of improved efficiency and improved consistency in operation.

SUMMARY OF THE INVENTION

Figure 1:
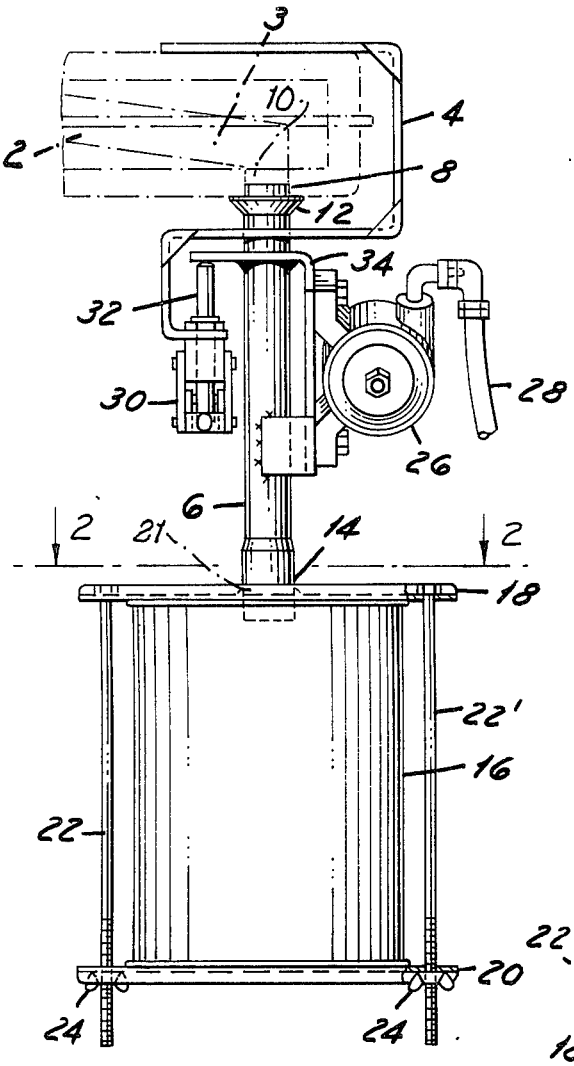
FIG. 1 is a side view of the catalytic converter emptying device of the present invention.
Figure 2:
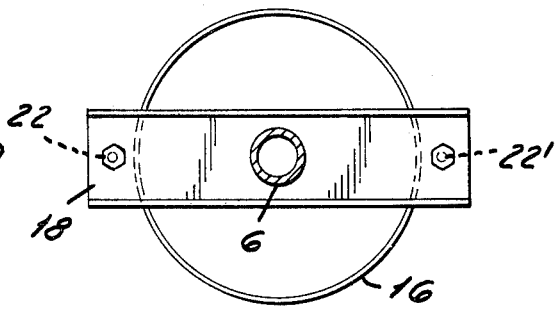
FIG. 2 is a top view of the device of FIG. 1 taken along the lines 2 — 2.

The present invention is concerned with an improved catalytic converter emptying device which has the capability of consistently removing pellets preferably assisted by gravity means from a catalytic converter. The apparatus involved is rigidly affixed to the catalytic converter or exhaust purifier of the internal combustion engine automobile by means of a clamping device or the like. A conduit is rigidly affixed at one end to the port in the catalytic converter through which spent catalyst pellets will flow to a receptacle or canister also rigidly affixed to the opposite end of the conduit. A vibrating means is attached to the device for imparting turbulence to the catalytic converter to assist in movement of the particles or pellets as they pass from the catalytic bed in the converter through the conduit into the receptacle. Preferably the receptacle or converter is rigidly affixed to the conduit by means of a pair of bars, one crossing the top of the receptacle and the other one crossing the bottom of the receptacle which are rigidly held in position by vertical connecting rods. The distinct advantage here is that the motion of the vibrator will facilitate the continuous vibratory movement of the entire apparatus including the converter housing and its contents. Accordingly, as the exhaust purifier or catalytic converter is vibrated, the the distant receptacle will likewise vibrate in phase with the purifier.

DESCRIPTION OF THE PREFERRED EMBODIMENT

The present invention is concerned with a catalytic converter emptying device comprising:

a catalytic converter unit having means for storing catalytic pellets; the storage means having a port for emptying the pellets from the converter therethrough;

a rigid connected to the port of the converter for passing the pellets from the converter;

a receptacle, rigidly attached to the conduit, for receiving the pellets from the converter unit, and vibrating means attached to their emptying device for vibrating the entire assembly of such rigidly connected parts in unison in order to impart turbulence to the converter unit and the pellets therein to cause the pellets to pass from the converter through the conduit to the receptacle. As later described herein, the illustrated embodiment of the invention can be operated with slight modification to reverse the flow of the catalytic pellets to fill the storage provision of the converter unit.

Having described the invention in general we turn now to a discussion of the figures. When it has been determined that the pellets (not shown) in the bed of the exhaust purifier or catalytic converter 2 need to be rejuvenated or replaced, then the emptying device of the present invention is rigidly attached to the catalytic converter, preferably by means of a C-shaped clamping device 4. During emptying of the pellets from the catalytic converter, conduit 6 of rigid material has one end thereof 8 snugly fitting into port means 10 of the catalytic converter with sealing means 12 surrounding the conduit 6 thereby preventing any dust from the pellets from passing to the environment. The opposite end 14 of the conduit 6 is rigidly affixed to receptacle means 16 which is shown as being securely held in place between bars 18 and 20. The bars rigidly hold the receptacle or cannister in place by means of rods 22 and 22'. The position of the bottom bar 20 is adjustable by means of wing nuts 24 and 24' to accomodate receptacles of different sizes.

The device of the present invention further employs vibrating means 26 which is shown as an air operated vibratory means indicated in FIG. 1 by inlet air tube 28.

During the operation of the device of the present invention spent catalytic particles from the purifier are vibrated by vibrating means 26 which is preferably attached by L-shaped bracket 34 to the conduit 6 using weld joints for this purpose as shown in FIG. 1. One end of the conduit is inserted into the exhaust purifier, and the other end is inserted into receptacle means 16. Clamping means 4 which clamps the device of the present invention to the catalytic converter is shown engaged by toggle clamp 30. When the ram 32 of the toggle clamp engages the bracket 34 the upper end 8 of conduit means 6 is slid into port 10 of the catalytic converter 2.

To remove the spent catalytic particles, air is passed through inlet tube 28 thereby operating vibrating means 26 which causes the particles to "dance" down the inclined catalytic bed 3. The particles then pass through the conduit means 6 into the receptacle means 16. The distinct advantage of the present invention is that the receptacle means is rigidly affixed to the conduit means 6. Varying sizes of receptacle means 16 are employed in order to correspond with the size of the catalytic bed. Some catalytic beds for six cylinder engines may be about 180 cubic inches while the catalytic bed for larger eight cylinder internal combustion engines would have a bed size of approximately 260 cubic inches. Accordingly receptacle means 16 would vary in content carrying capacity. This variation is provided by threaded rods 22 and 22' which are adjustable by wing nuts 24 and 24'. The receptacle means 16 rigidly engages conduit means 6 at the entrance port 21 of the receptacle means and is generally engaged thereat through an O-ring.

It is to be appreciated that various vibrating means may be employed such as electrical, mechanical, sound vibrators and the like. In addition, the vibrating means need not be rigidly affixed to the conduit means but may also be rigidly affixed to the catalytic converter or some other portion of the internal combustion engine vehicle or to the receptacle means. Suffice to say, however, the vibrating means should be sufficient to cause the particles or pellets to pass down the inclined bed 3 through the conduit means and into the receptacle means and generally this is by gravity feed technique assisted by the vibrations imparted to the emptying device.

When all of the components of the present invention are rigidly and securely held in place, then there is no dampening effect to counter-balance the vibrator. It has been found that such dampening effects severely limit the ability of a reasonably sized vibrator from sufficiently vibrating the particles or pellets which are snugly packed in the catalytic bed to pass from it by gravity means through the conduit means into the receptacle means. Such dampening effects occur if the catalytic converter, conduit means and receptacle means are not able to vibrate in phase with the vibrator.

It has also been found desirable that the vibrating means be adjusted so that it may be at an angle from about 10 to about 30 degrees from the vertical conduit means 6 so that the particles or pellets do not merely vibrate in place but due to the vertical component of the vibration they "walk" down the incline bed 3 and out the port 10 of the catalytic converter cannister means.

While toggle clamp 30 has been shown as a preferred means of clamping the device of the present invention to the catalytic purifier, any adjustable rocker arm plunger may be employed.

While the present invention has been described with respect to the most preferred embodiment which is the removal of spent pellets from the catalytic converter, it should be readily appreciated that the device may also be employed as a means for filling or refilling the catalytic converter. A preferred technique is that outlined in the aforesaid U.S. Pat. Nos. 3,184,291 and 3,295,565, hereby incorporated by reference. In those patents an air stream is circulated past the exhaust pipe of an internal combustion vehicle thereby creating a venturi effect and causing the particles which are in the receptacle 16 to pass upwardly through the conduit means 6 and into the catalytic bed means 3. It has been found desirable that the conduit means be provided with an extension reaching to the bottom of the receptacle means (not shown). This thereby removes all of the catalytic particles from the receptacle means into the catalytic bed means and the vibrating effect of vibrator 26 can pack the pellets snugly into the catalytic bed.

It is to be appreciated that a very convenient and portable catalytic converter emptying device and method has been described. It should be appreciated that clamping means 4, conduit means 6, vibrating means 26 and receptacle means 16 and all the attending parts thereof form a rigidly connected structure which can be readily removed from the catalytic converter 2 and may be reused any number of times in order to fill or empty the catalytic particles from any number of internal combustion engine vehicles.

What is claimed is:

1. An improved device for filling a catalytic converter with catalyst material and for emptying such material from such a converter while the converter is mounted in an automobile exhaust system including a conduit having means attached to one end thereof for clampingly engaging the catalytic converter mounted in the automobile exhaust system for rigid suspension therefrom and such that the upper end of the conduit is firmly connected to a port leading to the interior of the catalytic converter for passing catalytic material therethrough in one or the opposite direction, a rigidly formed receptacle attached to the other end of the conduit and adapted to hold catalytic material, and a vibrator rigidly connected to the conduit, the improvement comprising employing a substantially straight tube of rigid material throughout its length as the conduit and employing means for rigidly connecting the vibrator to the tube of rigid material and further means for rigidly yet releasably connecting the receptacle to the other lower end of the tube thereby enabling the tube, the receptacle and the catalytic converter from which the tube is rigidly suspended to be vibrated by the vibrator in phase with one another and thus avoiding the occurrence of any dampening action of any one of such parts of the device upon any one of the remaining parts of the device.

2. A pellet changer device for use with a gas purifier unit which is interiorly formed for storing gas purifying pellets and which has a normally closed port opening into the purifier unit through which such pellets are introduced or emptied therefrom, said changer device being composed of different cooperating components including a rigidly formed tube, which is substantially straight throughout its length, having one end thereof shaped for connection to the port of such gas purifier unit in order to pass such pellets in either direction therethrough, a clamping implement having one portion thereof coupled to the tube and another portion thereof clampingly engageable with the gas purifier unit for rigidly securing the tube to the port of the purifier unit, a rigidly formed receptacle for containing gas purifying pellets, and means for rigidly yet releasably connecting the receptacle to the other end of the tube, the result of these rigid connections being such that the components of the changer device and the air purifier unit to which the rigid tube is clampingly engaged are all connected together into a rigid assembly in which the parts thereof are inflexibly set against independent movement relative to one another, and vibrating means rigidly attached to the tube for vibrating all of the rigidly connected parts of the assembly in unison with one another thereby avoiding any detrimental vibratory dampening action of any one part of the assembly upon any other one or more of the remaining parts of the assembly.

* * * * *